US006742734B2

(12) United States Patent
Reed et al.

(10) Patent No.: US 6,742,734 B2
(45) Date of Patent: Jun. 1, 2004

(54) SYSTEM AND METHOD FOR MILLING MATERIALS

(75) Inventors: Robert G. Reed, Birdsboro, PA (US); David Czekai, Spring City, PA (US)

(73) Assignee: Elan Pharma International Limited, Shannon (IE)

( * ) Notice: Subject to any disclaimer, the term of this patent is extended or adjusted under 35 U.S.C. 154(b) by 63 days.

(21) Appl. No.: 10/162,333

(22) Filed: Jun. 4, 2002

(65) Prior Publication Data

US 2002/0179758 A1 Dec. 5, 2002

Related U.S. Application Data

(60) Provisional application No. 60/295,965, filed on Jun. 5, 2001.

(51) Int. Cl.[7] ..... B02C 17/16
(52) U.S. Cl. ..... 241/172; 241/184
(58) Field of Search ..... 241/101.2, 171, 241/172, 184

(56) References Cited

U.S. PATENT DOCUMENTS 4,620,673 A 11/1986 Canepa et al.
4,645,131 A * 2/1987 Hailey ..... 241/23
4,856,717 A 8/1989 Kamiwano et al.
4,870,875 A 10/1989 Morishita
5,118,528 A 6/1992 Fessi et al.
5,518,187 A 5/1996 Bruno et al.
5,862,999 A 1/1999 Czekai et al.
5,934,579 A * 8/1999 Hiersche et al. ..... 241/65
5,967,430 A * 10/1999 Getzmann ..... 241/29
6,336,603 B1 * 1/2002 Karkos et al. ..... 241/101.2

FOREIGN PATENT DOCUMENTS

EP 0 322 623 A2 7/1989
GB 947 530 1/1964

OTHER PUBLICATIONS

Magna–Safe™—www.magnasafe.com—2 pages.

* cited by examiner

*Primary Examiner*—Mark Rosenbaum
(74) *Attorney, Agent, or Firm*—Foley & Lardner LLP

(57) ABSTRACT

A system for milling at least one material, e.g., a drug. The system includes a milling apparatus and at least one milling medium. The milling apparatus includes a chamber having a rotary milling head located in it. The milling head is rotated within the chamber by a magnetic drive system.

18 Claims, 2 Drawing Sheets

SYSTEM AND METHOD FOR MILLING MATERIALS

RELATED APPLICATIONS

This application is a utility application based on Provisional Application Ser. No. 60/295,965 filed Jun. 5, 2001 entitled SYSTEM AND METHOD FOR MILLING MATERIALS, and whose entire disclosure is incorporated by reference herein.

FIELD OF THE INVENTION

This invention relates to milling of materials and more particularly to systems including magnetic drives for milling materials and methods of use of the same.

BACKGROUND OF THE INVENTION

In U.S. Letters Pat. No. 5,518,187, which is assigned to the same assignee as this invention and whose disclosure is incorporated by reference herein, there is disclosed a method of preparing particles of a drug or a diagnostic agent material. The method entails grinding the material in the presence of a grinding media, e.g., particles of a polymeric resin or ceramic. The polymeric resin grinding media can have a density from 0.8 to 3.0 g/cm.sup.3. and can range in size from about 0.1 to 3 mm. For fine grinding, the grinding media particles preferably are from 0.2 to 2 mm, more preferably, 0.25 to 1 mm in size. Alternatively, the grinding media can comprise particles comprising a core having a coating of the polymeric resin adhered thereon.

In U.S. Letters Pat. No. 5,862,999, which is assigned to the same assignee as this invention and whose disclosure is incorporated by reference herein, there is disclosed a method of preparing submicron particles of a therapeutic or diagnostic agent which comprises grinding the agent in the presence of grinding media having a mean particle size of less than about 75 microns. In a preferred embodiment, the grinding media is a polymeric resin. The method provides extremely fine particles, e.g., less than 100 nanometers in size, free of unacceptable contamination.

Agitator mills are known in the patent literature and are commercially available for effecting the milling of drugs, pharmaceuticals and the like. See for example U.S. Letters Pat. No. 4,620,673 (Canepa). In traditional prior art mills an agitator shaft is connected through some means to a motor. The agitator shaft is coupled at one point to a milling head and at another point to the motor. In order to keep the milled product from leaking in the area wherein the drive shaft extends into the mixing chamber, seals of some type, e.g., lip seals or mechanical seals, are used. As is known, lip seals have a rather short life span. Moreover, mechanical seals are somewhat unpredictable insofar as leakage rates and life spans are concerned. Further still, mechanical seals need a lubricant, which is typically purified water for pharmaceutical applications, thereby increasing the complexity of the structure and increasing the risk of contamination of the preparation.

Magnetically coupled mixers and pumps are commercially available for effecting the mixing or pumping of various materials. Examples of such devices are those offered by Magna-Safe International, Inc. of Woodbridge, N.J., under the Trademark MAGNASAFE.

While magnetically coupled mixers and pumps have been used previously for mixing operations, they have not been used or constructed for the production of small particle dispersions, such as the type now being utilized in the pharmaceutical, imaging, electronics and other fields. Thus, need presently exists for a magnetically coupled media milling machine for the production of small particle dispersions wherein a chamber or vessel containing the milling media and the material to be milled are located separately and without contact to the driving means that provides the grinding force. Moreover, there is a need for a magnetically coupled media milling machine for the production of small particle dispersions wherein a chamber or vessel containing the milling media and the material to be milled can be removed as an assembly after processing.

SUMMARY OF THE INVENTION

A system and method for milling at least one material. The system comprises a milling apparatus and at least one milling medium for use with the apparatus.

The apparatus comprises a milling chamber, a milling head, and a drive member. The milling chamber comprises a hollow vessel for receipt of the at least one material and the at least one milling medium therein. The drive member includes at least one drive magnet. The milling head is located within the milling chamber and is rotatably mounted with respect thereto. The milling head includes at least one driven magnet. The at least one drive magnet is magnetically coupled to the at least one driven magnet. The drive member is arranged to be rotated by an energy source, e.g., an electric motor, whereupon rotation of the drive member effects the concomitant rotation of the milling head with respect to the milling chamber. The milling head cooperates with the milling medium and with the at least one material to effect the milling of the at least one material within the milling chamber.

In accordance with one exemplary embodiment of the invention the drive member comprises an elongated drive shaft having a first end portion and a longitudinal axis. The at least one drive magnet is coupled, e.g., mounted, to the drive shaft at the first end portion. The milling head has a central bore. The milling chamber includes a spindle having a well in it. The spindle of the milling chamber is located in the central bore of the milling head but spaced slightly therefrom. The at least one driven magnet is located in the milling head adjacent the central bore. The at least one drive magnet is magnetically coupled to the at least one driven magnet via the spindle. The drive shaft is arranged to be rotated about the longitudinal axis by the energy source, whereupon rotation of the drive shaft about the longitudinal axis effects the concomitant rotation of the milling head about that axis. The milling chamber is removably mounted with respect to the drive shaft so that it can removed as a unit from the drive shaft. A removable cover is provided for the milling chamber.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENT

Figure 1:
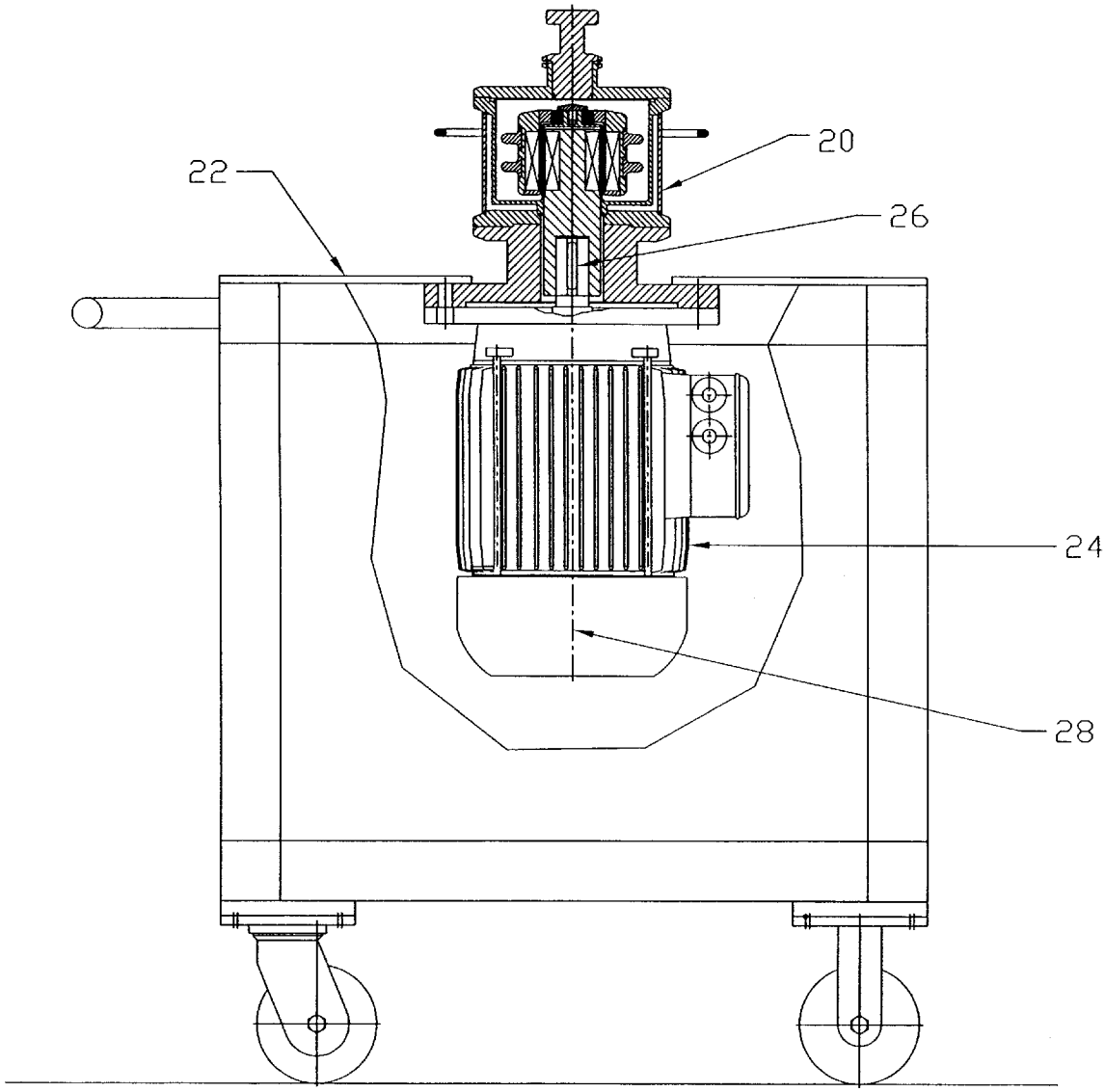
FIG. 1 is a front view, partially in section, showing a milling apparatus making use of a magnetic drive system constructed in accordance with one embodiment of this invention.

In FIG. 1 there is shown a portable milling apparatus 20 constructed in accordance with this invention. That apparatus is arranged to be used with a milling media 10 (see FIG. 2) in the form of very small spherical beads. It is preferable if the milling media have a mean diameter of between 0.05 mm to 0.5 mm. The media particles can be made of various materials such as stainless steel, zirconium silicate, zirconium oxide, glass, plastics, such as cross-link polystyrene, etc. One particularly effective material is 0.2 mm cross linked polystyrene which provides a lower amount of impurities as compared to glass, ceramic or stainless steel. In the embodiment shown herein, in FIG. 2, the particles 10 are shown exaggerated in size (not to scale). The size and composition of the particles given above is merely exemplary. Thus, other milling media such as those disclosed in the two aforementioned patents incorporated by reference herein or other commercially available milling media may be used. The media 10 and the apparatus 20 together form a system making up the subject invention.

Referring now to FIG. 1, it can be seen that the apparatus 20 basically comprises a rolling cart 22 having a frame supporting an electric drive motor 24. The drive motor includes an output shaft 26 directed upward and centered on a central longitudinal axis 28. The motor's output shaft 26 is arranged to be received in a bore 30 in a cylindrical, rod-like drive shaft 32, as shown more particularly in FIG. 2. The motor includes an upper flange 34 which is arranged to be secured, such as by bolts (not shown) to a motor flange adapter 36. The motor flange adapter 36 is itself mounted below a top panel 38 of the cart via bolts (not shown).

The motor flange adapter 36 is arranged to mount thereon a milling chamber 40. The details of the milling chamber will be described later. Suffice to say that the milling chamber is a hollow vessel in which the milling media 10 is located. Also located within the milling chamber 40 is a milling head 42. The head 42 includes a plurality of pegs 44 projecting radially outward therefrom to effect agitation of the beads and the product to be milled. In this embodiment, there are four pairs of pegs 44.

The milling chamber includes a cover or lid 46 to seal its interior from the ambient surroundings.

In order to couple the rotary output of the motor 24 as provided by its output shaft 26 to the agitating or milling head 42, a magnetic drive assembly, to be described hereinafter, is provided. That drive assembly basically comprises a plurality (at least one pair), e.g., 2, 4, etc., of magnets 48 located at equidistantly spaced positions around the periphery of the drive shaft 32 at the distal (upper) end thereof. The magnets 48 serve as the "drive" magnets for the system. The drive magnets are arranged to be magnetically coupled to plural "driven" magnets 50. The driven magnets 50 are preferably the same in number as the drive magnets or a multiple (e.g., 2 drive magnets and 4 driven magnets; 4 drive magnets and 8 driven magnets, etc.) and are located within the milling head 42 at equidistantly spaced locations about the longitudinal central axis of the milling head and close to the drive magnets 48 (as will be described hereinafter) so they are magnetically coupled to one another. Accordingly, rotation of the drive magnets 50 about the longitudinal axis 28 causes the concomitant rotation of the milling head 42 thereabout.

Figure 2:
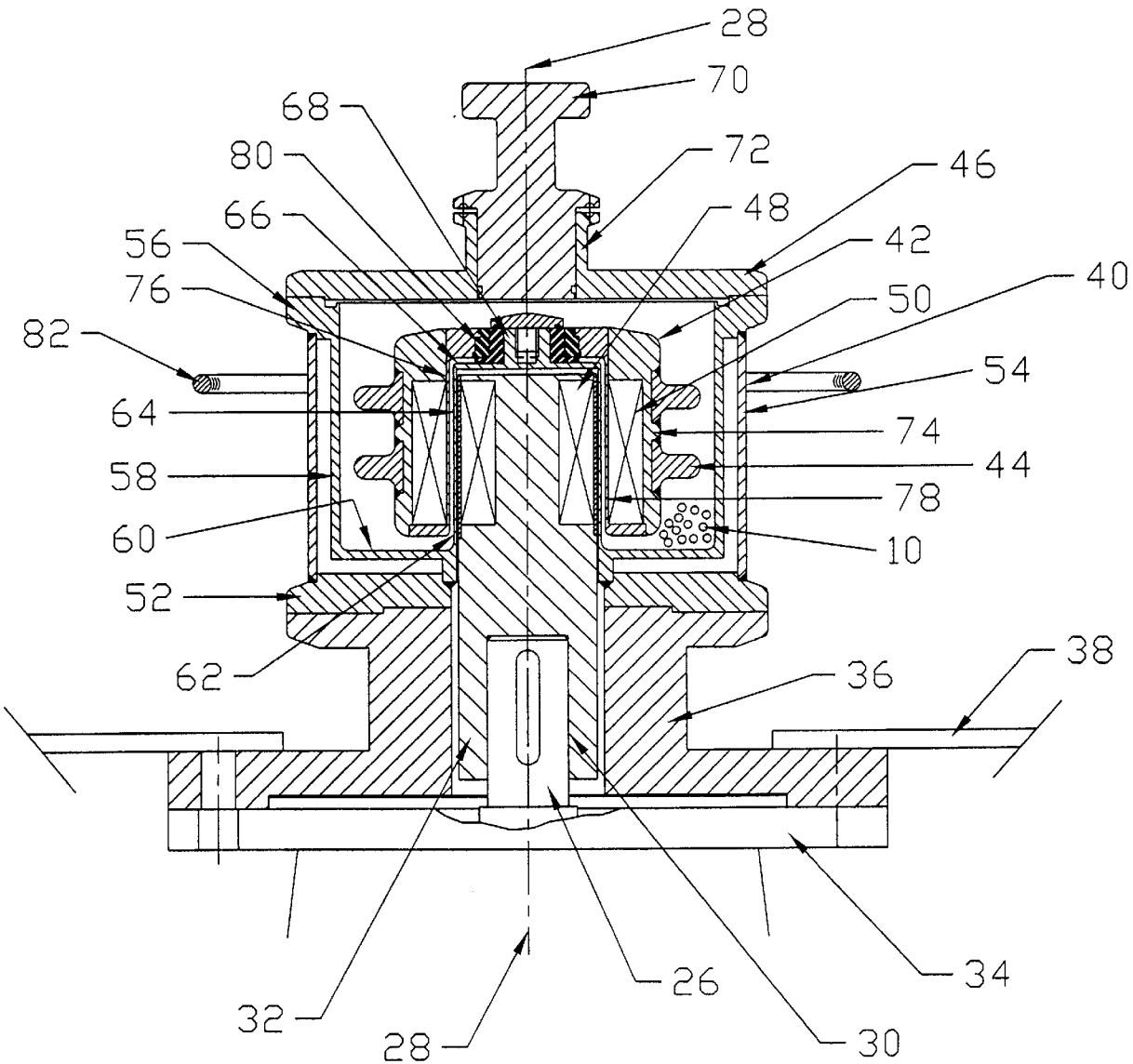
FIG. 2 is an enlarged vertical sectional view of a portion of the apparatus shown in FIG. 1.

The details of the milling chamber 40 will now be described with reference to FIG. 2. As can be seen therein, the milling chamber 40 basically comprises a planar, disc-like base plate 52 from which an outer circular cylindrical wall 54 projects. A cup-shaped member 56 is mounted on the top edge of the circular outer wall 54 and includes a circular cylindrical inside wall 58 and an annular, planar bottom wall 60. Upstanding from the bottom wall is a hollow cylindrical spindle 62. The spindle 62 is formed by a cylindrical circular sidewall 64 and a planar top wall 66. A central hub 68 projects upward from the top wall 66 centered on the longitudinal axis. As should be appreciated from the foregoing the inner surface of the sidewall 58, the inner surface of the bottom wall 60, the outer surface of the sidewall 64 of the spindle 62 and the top surface 66 of the spindle form the interior of the milling chamber 40 of the apparatus 20. The top of the milling chamber 40 is covered by the cap 46 which is releasably secured to the flange portion of member 56. A plug 70 extends through a flanged port in the cap 46. The plug 70 is removable from the cap 46 to enable the milling media 10 and the product to be milled to be introduced into the mixing chamber 40 through the port 72.

The milling head 42 basically comprises an inverted cup-shaped member 76 having an outer sidewall 74 from which the aforementioned pegs 44 project. In particular, there are four pairs of pegs 44. The pegs 44 of each pair are disposed in a vertical array one on top of the other and the pairs themselves are disposed at equidistantly spaced positions, e.g., 90°, about the periphery of the milling head sidewall 74. The central inverted cup-shaped member 76 has an inside wall 78. The plural magnets 50 are interposed in the space between the inside wall 78 and the milling head sidewall 74. The upper end of the inverted cup-shaped member includes a central passageway in which a bearing set, e.g., a pair of silicon carbide bearings 80, is located. The bearing set 80 mounts the milling head 42 on the spindle 62, with the outer surface of the spindle being spaced slightly from the outer surface of the milling head's inner wall 78.

The distal (upper) end of the drive shaft 32, that is the portion with the magnets 48, is disposed within the hollow interior or well of the spindle 62 so that the drive magnets 48 are disposed immediately adjacent the driven magnets 50 with the thin wall 64 of the spindle and the thin wall 76 of the agitating head disposed therebetween. This magnetically couples the drive and driven magnets to each other. A small air gap, e.g., 1–5 mm, separates these two walls (i.e., the outer wall of the spindle and the inner wall of the milling head) from each other.

As should be appreciated from the foregoing, the rotation of the motor's output shaft 26 causes the concomitant rotation of the drive shaft 32, thereby rotating the magnets 48 at a high rate of speed, e.g., 2,000 to 3,000 rpm, about the central longitudinal axis 28. Since the "driven" magnets 50 are disposed closely adjacent to the drive magnets, the rotation of the drive magnet causes concomitant rotation of the driven magnets about that axis, thereby rotating the milling head 42 about that axis at that speed. Thus, the milling head rotates at the speed of the motor about the spindle 620 supported by the bearing set 80 while the milling chamber 40 remains stationary. The rotation of the milling head and its pegs about the central axis 28 within the stationary milling chamber mills the product down to the desired size. This is achieved by two factors, namely, impact and shear. Insofar as impact is concerned, the rotation of the pegs causes turbulence in the milling media beads 10 so that the various beads of the media collide with one another with some product particles either being between the colliding beads or being impacted by such beads. In any case, the impact causes the milling of those particles, thereby reducing the particle size. In addition to the impact, the rotation of the milling head 42 causes the beads of the milling media 10 to roll along the interior surfaces of the chamber 40 and with respect to each other. This creates shear, which acts on the interdispersed product particles to further reduce the size of those particles.

In accordance with one preferred embodiment of this invention, the gap exterior of the spindle and the interior of the milling head 42 is somewhere in the range of a 6-to-1 ratio of gap size to milling bead size. For example, if the milling media is 0.2 mm, the gap size can be 1.5 mm. It will be appreciated by those skilled in the art that while a bigger gap size is desirable for resistance to clogging, it is undesirable from a torque transmission standpoint, since the larger the spacing will necessitate the use of larger magnets to get a desired amount of torque to rotate the milling head.

In accordance with one preferred aspect of the invention and as a result of the magnetic drive assembly, the milling chamber 40 with the milling head therein can be removed as a unit from the apparatus 20. To that end a handle 82 is provided coupled to the chamber 40 to enable the chamber to be lifted off of the motor flange adapter 36. When that unit is lifted off the drive shaft adapter 32 exits the well in the spindle. This leaves the cart 22 of the apparatus 20 ready to receive another milling chamber 40 with a milling head 42 therein to effect the milling of some other product, while the chamber/milling head that had been used is taken to some location for filtering out the milled product from the media for subsequent use. The milling media can then be removed from that chamber and the chamber cleaned and otherwise readied for next usage.

As should be appreciated from the foregoing, the structure of the subject system avoids the use of mechanical seals or lip seals. This eliminates what is typically a very expensive component of the media mill in the case of the former and a short life component in the case of the latter. The lack of a seal in the subject invention results in an apparatus that requires less maintenance, less downtime and lower maintenance costs. In addition, the danger of contamination by seal water or some other lubricant is eliminated. This increases the quality of the resulting product. Other benefits of the subject system include the ease of cleaning, e.g., the mixing chamber and agitating head which are removed as a unit can be readily cleaned in a sink or washtub. Moreover, the small milling size chamber enables it to be effectively used for batch processing, e.g., the addition of the product and media via a glove box or laminar flow hood. Moreover, the system, being a "closed" one allows the product and media to be added to the milling chamber and then autoclaved to create a sterile product. Lastly, the subject apparatus enables the batch milling process to be achieved with minimum equipment parts to simplify manufacturing of small quantities of clinical test materials. Finally, the manner in which the magnets are mounted with respect to the adapter drive shaft 32 and the milling head 42 keeps the magnets from coming in contact with the product being milled.

It should be pointed out at this juncture that the milling system of this invention may include a milling head including more or less agitating pegs and which are arranged in different configurations from that discussed above. Moreover, the milling head need not make use of any pegs, but can make use of any type of member for effecting agitation/shear of the product/media located within the milling chamber. Thus, it is contemplated that the milling head can comprise a smooth walled cylindrical member without any elements projecting outward therefrom. In such an embodiment the milling operation is effected primarily, if not exclusively, by shear, whereas in the embodiment discussed above the milling operation is effected by a combination of impact and shear. Moreover, the size and shape of the various components, the number, type, and orientation of the magnets utilized, and the speed of rotation of the milling head can be modified as desired depending upon the product to be produced and other factors. For example, the size of the air gap between the spindle and the milling head can be different than that described, depending upon the size of the milling medium/media used.

It should also be pointed out that while the foregoing description of the milling apparatus has been of a vertical mill, e.g., a vertically oriented drive shaft, rotating shaft, other arrangements can be utilized as well. Thus, for example, the subject invention contemplates a horizontal mill.

It is further appreciated that the present invention may be used to produce a number of therapeutic or diagnostic agents, collectively referred to as a "drug." The drug is typically present in an essentially pure form, is poorly soluble, and is dispersible in at least one liquid medium. By "poorly soluble" it is meant that the drug has a solubility in the liquid dispersion medium of less than about 10 mg/mL, and preferably of less than about 1 mg/mL. A therapeutic agent can be a pharmaceutical, including biologics such as proteins and peptides, and a diagnostic agent is typically a contrast agent, such as an x-ray contrast agent, or any other type of diagnostic material. The drug exists as a discrete, crystalline phase. The crystalline phase differs from a non-crystalline or amorphous phase which results from precipitation techniques, such as those described in EP Patent No. 275,796. The term "drug" used herein includes, but is not limited to, peptides or proteins (and mimetics thereof), antigens, vaccines, hormones, analgesics, anti-migraine agents, anti-coagulant agents, medications directed to the treatment of diseases and conditions of the central nervous system, narcotic antagonists, immunosuppressants, agents used in the treatment of AIDS, chelating agents, anti-anginal agents, chemotherapy agents, sedatives, anti-neoplastics, prostaglandins, antidiuretic agents and DNA or DNA/RNA molecules to support gene therapy.

Typical drugs include peptides, proteins or hormones (or any mimetic or analogues of any thereof) including, but not limited to, insulin, calcitonin, calcitonin gene regulating protein, atrial natriuretic protein, betaseron, erythropoietin (EPO), interferons including, but not limited to, α, 'O, and 'O-interferon, somatropin, somatotropin, somastostatin, insulin-like growth factor (somatomedins), luteinizing hormone releasing hormone (LHRH), factor VIII, interleukins including, but not limited to, interleukin-2, and analogues or antagonists thereof, including, but not limited to, IL-1ra, thereof; hematological agents including, but not limited to, anticoagulants including, but not limited to, heparin, hirudin and analogues thereof, hematopoietic agents including, but not limited to, colony stimulating factors, hemostatics, thrombolytic agents including, but not limited to, tissue plasminogen activator (TPA); endocrine agents including, but not limited to, antidiabetic agents, antithyroid agents, beta-adrenoceptor blocking agents, growth hormones, growth hormone releasing hormone (GHRH), sex hormones including, but not limited to, estradiol, thyroid agents, parathyroid calcitonin, biphosphonates, uterine-active agents including, but not limited to, oxytocin and analogues thereof; cardiovascular agents including, but not limited to, antiarrhythmic agents, anti-anginal agents including, but not limited to, nitroglycerine, and analogues thereof, anti-hypertensive agents and vasodilators including, but not limited to, diltiazem, clonidine, nifedipine, verapamil, isosorbide-5-mononitrate, organic nitrates, agents used in treatment of heart disorders, and analogues thereof, cardiac inotropic agents; renal and genitourinary agents including, but not limited to, diuretics; antidiuretic agents including, but not limited to, desmopressin, vasopressin, and analogues thereof; respiratory agents including, but not limited to, antihistamines, cough suppressants including, but not limited to, expectorants and mucolytics, parasympathomimetics, sympathomimetics, xanthines and analogues thereof; central nervous system agents including, but not limited to, analgesics including, but not limited to, fentanyl, sufentanil, butorphanol, buprenorphine, levorphanol, morphine, hydromorphone, hydrocodone, oxymorphone, methadone, lidocaine, bupivacaine, diclofenac, naproxen, paverin, and analogues thereof, anesthetics, anti-emetic agents including, but not limited to, scopolamine, ondansetron, domperidone, metoclopramide, and analogues thereof, anorexiants, antidepressants, anti-migraine agents including, but not limited to, sumatriptan, ergot alkaloids, and analogues thereof, antiepileptics, dopaminergics, anticholinergics, antiparkinsonian agents, muscle relaxants, narcotic antagonists, sedatives including, but not limited to, benzodiazepines, phenothiozines, and analogues thereof, stimulants, treatments for attention deficit disorder, methylphenidate, fluoxamine, bisolperol, tactolimuls, sacrolimus and cyclosporin and analogues thereof; gastrointestinal agents including, but not limited to, prostaglandins and analogues thereof; systemic anti-infectives including, but not limited to, antibiotics, antiviral agents, anti-fungals, agents used in the treatment of AIDS, anthelmintics, antimycobacterial agents; biologic and immunologic agents including, but not limited to, immunosuppressants, vaccines, hormones; dermatological agents including, but not limited to, anti-allergic agents, astringents, anti-inflammatory agents including, but not limited to, corticosteroids, elastase inhibitors, antimuscarinic agents, lipid regulating agents, blood products and substitutes; antineoplastic agents including, but not limited to, fluorouracil, bleomycin, and analogues thereof, leuprolide acetate, chemotherapy agents including, but not limited to, vincristine, and analogues thereof, oncology therapies; diagnostic aids including, but not limited to, diagnostic agents, diagnostic imaging agents, radio-pharmaceuticals, contrast media including, but not limited to, an x-ray contrast agent; nutrients and nutritional agents including, but not limited to, chelating agents including, but not limited to, deferoxamine, and analogues thereof.

A description of these classes of drugs and a listing of species within each class can be found in Martindale, *The Extra Pharmacopoeia*, Twenty-ninth Edition (The Pharmaceutical Press, London, 1989), specifically incorporated by reference. The drugs are commercially available and/or can be prepared by techniques known in the art.

While the invention has been described in detail and with reference to specific examples thereof, it will be apparent to one skilled in the art that various changes and modifications can be made therein without departing from the spirit and scope thereof.

We claim:

1. A system for milling at least one material, said system comprising:

(a) at least one milling medium for use therewith, (b) a milling apparatus comprising:

(i) a milling chamber, said milling chamber comprising a hollow vessel for receipt of the at least one material and said at least one milling medium therein;

(ii) a milling head located within said milling chamber, wherein: (a) the milling head is rotatably mounted with respect to the milling chamber, (b) the milling head includes at least one driven magnet, (c) the milling head has a central bore in which a portion of said milling chamber is located but spaced slightly therefrom, and (d) said at least one driven magnet is located adjacent to said central bore, and (iii) a drive shaft member comprising:

(1) at least one drive magnet which is magnetically coupled to said at least one driven magnet, and said drive member being arranged to be rotated by an energy source, and (2) a first end portion, wherein said at least one drive magnet is coupled to said drive shaft at said first end portion, and (3) a longitudinal axis, said drive shaft being arranged to be rotated about said longitudinal axis by the energy source, whereupon rotation of said drive shaft member about said longitudinal axis effects the concomitant rotation of said milling head about said longitudinal axis, said milling head cooperating with said at least one milling medium and with the at least one material to effect the milling of the at least one material within said milling chamber.

2. The system of claim 1 wherein said portion of said milling chamber comprises a spindle having a central well therein.

3. The system of claim 2 additionally comprising at least one bearing rotatably mounting said milling head on said spindle.

4. The system of claim 2 wherein said first end portion of said drive shaft is located within said central well and wherein said at least one drive magnet is magnetically coupled to said at least one driven magnet via said spindle.

5. The system of claim 4 wherein said milling head includes at least one member projecting outward therefrom for cooperating with said milling medium and with the material to effect the milling of the at least one material within said milling chamber.

6. The system of claim 5 wherein said milling head comprises a plurality of pegs projecting outward therefrom.

7. The system of claim 4 wherein said at least one drive magnet is a rare earth magnet.

8. The system of claim 4 wherein said milling media comprise a plurality of small bodies.

9. The system of claim 8 wherein said small bodies are approximately 500 microns in mean diameter or less.

10. The system of claim 9 wherein said at least one milling media comprise polymeric material.

11. The system of claim 4 wherein said at least one milling media comprise polymeric material.

12. The system of claim 1 wherein said milling chamber is removably mounted with respect to said drive shaft, whereupon said milling chamber and said milling head can be removed as a unit from said drive shaft.

13. The system of claim 12 wherein said milling chamber includes a removable cover.

14. The system of claim 1 wherein said milling chamber includes a removable cover.

15. The system of claim 14 wherein said drive shaft is oriented vertically and the energy source is a motor to which said drive shaft is coupled.

16. The system of claim 1 wherein said milling head includes at least one member projecting outward therefrom for cooperating with said milling medium and with the material to effect the milling of the at least one material within said milling chamber.

17. The system of claim 16 wherein said milling head comprises a plurality of pegs projecting outward therefrom.

18. The system of claim 1 additionally comprising at least one bearing rotatably mounting said milling head on said portion of said milling chamber.

* * * * *